US008348245B2

(12) United States Patent
Fischer

(10) Patent No.: US 8,348,245 B2
(45) Date of Patent: Jan. 8, 2013

(54) IMPREGNATOR

(75) Inventor: Georg Fischer, Deiningen (DE)

(73) Assignee: Carbotek Holding GmbH, Nördlingen (DE)

( * ) Notice: Subject to any disclaimer, the term of this patent is extended or adjusted under 35 U.S.C. 154(b) by 709 days.

(21) Appl. No.: 11/989,688

(22) PCT Filed: Mar. 28, 2007

(86) PCT No.: PCT/EP2007/002718

§ 371 (c)(1),
(2), (4) Date: Nov. 30, 2009

(87) PCT Pub. No.: WO2007/112892

PCT Pub. Date: Oct. 11, 2007

(65) Prior Publication Data

US 2010/0133708 A1 Jun. 3, 2010

(30) Foreign Application Priority Data

Mar. 29, 2006 (DE) ..... 10 2006 014 814
Oct. 11, 2006 (DE) ..... 10 2006 048 456
Oct. 11, 2006 (DE) ..... 10 2006 048 457

(51) Int. Cl.
*B01F 3/04* (2006.01)

(52) U.S. Cl. ..... 261/76; 261/DIG. 7; 99/323.1; 366/101

(58) Field of Classification Search ..... 261/59, 261/76, 78.2, DIG. 7; 99/323.1; 366/101
See application file for complete search history.

(56) References Cited

U.S. PATENT DOCUMENTS

| | | | | |
|---|---|---|---|---|
| 636,162 | A | 10/1899 | Murphy | |
| 656,034 | A * | 8/1900 | Murphy | 261/19 |
| 3,761,066 | A | 9/1973 | Wheeler | |
| 6,138,995 | A | 10/2000 | Page | |
| 6,712,342 | B2 | 3/2004 | Bosko | |
| 7,318,581 | B2 * | 1/2008 | Robards et al. | 261/59 |

FOREIGN PATENT DOCUMENTS

| | | |
|---|---|---|
| CA | 2350202 | 5/2000 |
| DE | 10055137 | 5/2002 |
| DE | 10160397 | 6/2003 |
| GB | 1484461 | 9/1977 |

* cited by examiner

*Primary Examiner* — Robert A Hopkins
(74) *Attorney, Agent, or Firm* — Bacon&Thomas, PLLC

(57) ABSTRACT

An impregnator for mixing a nonaerated or only slightly aerated liquid (F) with gas (G), in particular for mixing a noneffervescent or only slightly effervescent beer precursor product, or a beer precursor product containing $CO_2$, with $CO_2$, includes a mixing cell, in particular tubular, which except for an incoming liquid inlet, an incoming gas inlet, and an outlet, is partitioned off from the surrounding, and at least one Impregnator body is disposed in the mixing cell in such a way that the flow through the mixing cell of the liquid (F) and gas (G) must necessarily take place through the impregnator body. Disposed in the mixing cell is at least one impregnator body, which includes a porous solid body, namely of a foam material, a sponge, a follow fiber module, or a sintered material.

35 Claims, 5 Drawing Sheets

IMPREGNATOR

BACKGROUND OF THE INVENTION

1. Field of the Invention

The invention relates to an impregnator for mixing a nonaerated or only slightly aerated liquid with a gas. The invention also relates to a pressure compensator assembly for bar systems, an impregnator for inline gassing bar systems, and a bar system with a pressure compensator assembly. The invention further relates to novel uses of such an impregnator. The nonaerated or only slightly aerated liquid may be a soda, soft drink, water, juice, or a low-carbon-dioxide or carbon-dioxide-free beer precursor product. The gas be carbon dioxide or nitrogen.

2. Description of Related Art

Impregnation in terms of the invention is the release of gases into liquids, or in other words impregnating liquids with gases, as it is carried out in absorption columns in large-scale chemical systems. For example, according to the German Patent DE 25 03 681, a gas is conducted from the bottom of a column to the top of the column in counter current to a liquid, which flows from the top to the bottom, wherein the column is filled with a porous ceramic material.

Such impregnators are used in bar systems, so that liquids or beverage precursor products can be impregnated with gases, or gases can be released into the liquids and beverages ready to drink can thus be produced, but only once they are in the bar system. Examples of liquids to be impregnated, sodas (syrups) and in particular a low-carbonation or carbonation-free beer precursor product can be considered. Besides gases that contain flavorings, in particular carbonic acid (more precisely, $CO_2$) and nitrogen (more precisely, $N_2$) can be considered as impregnating gases, in particular for creating a bubbly soda and in particular a carbonated beer.

The term "carbonic acid" or "carbonated" is indeed usual in beverages, but more precisely, carbon dioxide ($CO_2$) is added, which by far predominantly bonds only physically in the liquid and does not enter into any chemical reaction to form carbonic acid ($H_2CO_3$).

This physical bond upon the release of gases into liquids is a mass transfer process in accordance with the laws of physical absorption. This transfer process takes place at the gas-liquid phase boundary faces. The gas diffuses into the liquid. While nonpolar nonelectrolytes, such as oxygen and nitrogen, on becoming dissolved are incorporated primarily into the voids between the liquid molecules, polar electrolytes, such as carbon dioxide, in water form water bridges with the likewise polar water molecules, and these bridges cluster with other water molecules to form supermolecular assemblies. $CO_2$ molecules, for example, penetrate the microstructure of the water molecules quite well. The mass transfer of gases into liquids is described in simplified form in Fick's first law:

$$Mi=A(Ci^*-C1)=(Di/\delta i)A\xi(Pi^*-P1).$$

In the equation,

Mi stands for the mass flow of a gas from the gas phase into the liquid;

A stands for the area of the surface at which the mass transfer takes place;

(Ci*−C1) stands for the concentration gradient between the equilibrium concentration at the phase boundary face and the instantaneous concentration in the liquid;

δ stands for the length of the transportation course from the interior of the liquid to the phase boundary face;

Di stands for the diffusion coefficient for gases;

ξ stands for the absorption coefficient (of the solubility of gases) as a function of temperature, pressure, and material; and (Pi*−P1) stands for the pressure drop between the partial pressure of the gas and the pressure applied at that instant in the liquid.

Accordingly, the speed (Mi) at which a state of equilibrium is established in a liquid depends on the concentration gradient, the diffusion coefficient for gas, the absorption coefficient, the surface area, the length of the transportation course, the prevailing pressure, and the temperature.

Efficient mass transfer systems must therefore have a large surface area where the mass transfer can take place, must create high turbulence for the shortest possible transportation courses, and must furnish both high pressure and low temperatures, so as to attain the most efficient and fastest possible mass transfer in one phase.

Besides known bubble-forming systems, such as agitation systems, loop reactors or injection systems, which are not very economical because of their vulnerability and in particular the high expense for equipment in injection systems (pressure vessel, pressure pump, cooling system) and the attendant high operating costs, carbonators or impregnators of the type defined at the outset have become established in the field of gassing beverages with carbonic acid in bars and pubs.

By means of a predetermined gas and liquid pressure—in the impregnation of an uncarbonated beer precursor product with $CO_2$, a liquid pressure of 4 bar and a gas pressure of 5 bar, for instance, or a liquid pressure of 5 bar and a gas pressure of 5.5 bar, have proven suitable—the attempt is made to establish the desired ratio of gas to liquid in the mixing cell and an optimal pressure in the mixing cell, so that the desired dissolution of the gas in the liquid takes place.

However, such impregnators are often used in inline gassing bar systems, in which the beverage precursor product is conventionally pumped out of a tank with piston pumps and more recently also from a bag using diaphragm pumps, so that the impregnator is exposed on the inlet side to the pressure surges of the piston pump, and a constant fuel pressure cannot be attained. The volumetric flow discharging into the mixing cell per unit of time therefore depends substantially on the speed with which the bartender taps the beverage. If the tapping speed changes, the pressure drop from the gas infeed or liquid infeed side to the mixing cell changes as well, so that the degree to which the gas infeed and liquid infeed open fluctuates even though the external pressure is set to a fixed value. As a result, the volumetric flows discharging into the mixing cell change as well, so that the gas-liquid mixture ratio may deviate from the optimum for dissolution of the gas in the liquid at whatever pressure prevails in the mixing cell.

In bar systems, a beverage is pumped via a beverage infeed line from a beverage container to a dispensing tap, usually located at a higher level. In conventional bar systems, the beverage infeed line comprises a bar line; in bar systems with inline gassing, or pressure gassing stages in the bar, one or more impregnators may also be disposed in the beverage infeed line, and with them a beverage precursor product is enriched for instance with carbonic acid. In so-called post-mixing bar systems, mixing valves for syrup with an inline-aerated water can be located in the beverage infeed line, along with a buffer container in which the water is aerated in a carbon dioxide atmosphere.

An impregnator, wherein water is impregnated with a carbon dioxide under a carbon dioxide atmosphere is disclosed in U.S. Pat. No. 636,162. The gas and the liquid pass through wire-cloth sieves and the impregnated liquid gas mixture is conducted in a buffer container.

For pumping the beverage or beverage precursor product through the beverage infeed line, a defined pumping pressure is necessary. In conventional bar systems, this pressure is furnished for instance via a compressed gas (such as carbon dioxide), whose pressure is exerted on a beverage keg or drink container, so that the beverage is forced upward to the dispensing tap via the dispensing line. In bar systems with a pressure gassing stage in the bar, which operate by the inline carbonation process and in which a so-called impregnator is provided in order to provide a low-carbonic acid or carbonic acid-free beverage precursor product in the bar system with carbonic acid or the like, conversely the beverage container is followed downstream by a pump, with which the beverage precursor product is pumped out of the beverage container to the impregnator and becomes carbonated there, or in other words mixed with carbonic acid (or more precisely, carbon dioxide), so that then it can be pumped as a beverage, with the carbonic acid dissolved in it, to the dispensing tap.

This requires a certain working pressure, which is above the keg pressure and the dispensing pressure. In inline gassing of beer, for instance, a pressure in the impregnator of 4 to 5 bar has proved suitable.

To enable adjusting the desired tapping speed of the dispensing tap, it is therefore necessary to artificially increase the pressure loss in the bar system, so that for instance an overly high pumping pressure, or the overpressure necessary for the inline gassing, is reduced, for instance to the keg pressure level that is usual in conventional bar systems. In conventional beer dispenser systems, for instance, a maximum of 1.5 to 3 bar, often 2.2 to 3 bar, of keg pressure is typical.

One possibility for this is to wind up the line in the form of a coil. So-called pressure compensators are also known, which today are usually directly integrated with the dispensing tap. In that case, a displaceable throttle restriction is disposed in the line leading to the dispensing tap, and its location can be adjusted by the bartender via an adjusting screw in such a way that the throttle restriction opens up an annular gap of a desired thickness, and the resistance can thus be varied and adapted to the desired conditions. With the adjusting screw, the bartender sets the dispensing tap to a desired flow rate, which is oriented for instance to whether he wants to fill large vessels, such as 1-liter steins, or small vessels, such as 0.25-liter soda glasses, and also depends on the liquid to be tapped, such as pale beer versus wheat beer.

Especially in bar systems with a pressure gassing stage in the bar, in which systems a working pressure in the impregnator is required that is above the keg pressure that is usual in conventional bar systems, the problem arises that regulating the quantity is no longer readily possible at the dispensing tap. If the bar system is used for beer, the beer "rips open", or in other words begins to foam since carbonic acid is being released. This release is due to the fact that the dispensing tap pressure compensator is designed for a certain pressure range. If the line pressure is markedly higher than intended, the laminar flow is impeded, and eddies occur as a consequence of which carbonic acid is released.

If a compressed-air diaphragm pump is used at the dispensing tap, fluctuations in the pumping pressure can also occur. The tap pressure, however, should be constant, since otherwise, if pressure fluctuations occur, an unwanted release of carbonic acid can occur.

The U.S. Pat. No. 6,712,342 B2 and U.S. Pat. No. 6,138,995 disclose beverage dispensers, wherein hollow fiber membranes or bundles are provided. The hollow fiber membranes or bundles contain hydrophobic hollow fibers, which serve as impregnator bodies. $CO_2$ passes through the impregnator bodies and the liquid to be impregnated washes round the impregnator bodies. Only the gas can pass through the walls of the hollow fibers and impregnates thereby the liquid on the other side of the wall.

An impregnator of this kind is proposed for instance in German Patent Disclosure DE 198 51 360 A1. This involves a tubular sieve carbonator, in which many mixing sieves are lined up with one another in a mixing cell, embodied as a tube, to which the gas and liquid infeeds can be connected. The mixing sieves together offer the desired large surface area at which the mass transfer can take place upon dissolution of the carbonic acid in the beverage precursor product. A tubular sieve carbonator of this kind can also be found in German Patent Application DE 100 55 1371 A1.

In U.S. Pat. No. 3,761,066 as well, a tubular sieve carbonator of this kind is shown, in which the gas and water supplied has to flow through a plurality of wire cloth mixing sieves: Gas is fed in from the side and water from above. The gas passes through a filter and an adjoining nozzle or impact plate to reach a prevortexing stage that the liquid also enters, namely through openings in the circumference of a cylindrical perforated plate. The flow thus created passes through openings in a conical perforated plate to enter the actual impregnation stage. Cylindrical wire cloth rings are located there, and plates are disposed between the individual wire cloth rings, so that the flow experiences a slalom through the wire cloths and in the process is impregnated. The annular wire cloth elements may be formed of any material that has (liquid-) permeable properties and is suitable for use in the carbonator shown.

Such tubular sieve carbonators, however, are not only relatively expensive in terms of material costs because of the high number of metal sieves but are also expensive with regard to the correspondingly complex assembly.

Recently, bulk material carbonators have therefore also been proposed, for instance in German Patent Application DE 101 60 397 A1. From this reference, a bulk material carbonator is found, with a mixing cell that is filled with a bulk material that has a high surface area, such as quartz pellets or the like. Other granular materials have also been proposed as the bulk material, such as fine plastic pellets or fine steel pellets made by VA Stahl. The surface area attainable with the bulk material, however, is still limited. This is because floating of the bulk material out of the impregnator must absolutely be avoided, at least in the field of foodstuffs, and thus the bulk material, despite the requirement for a large surface area, cannot be allowed to be ground arbitrarily fine so as not to clog the requisite trapping systems for the bulk material. Nevertheless, clogging cannot be completely avoided over the course of time, and bulk material carbonators must therefore be replaced relatively often. It is also disadvantageous that such bulk material carbonators are relatively difficult to clean, so that at the cleaning intervals necessary for reasons of food hygiene, especially in connection with beverages containing starch or sugar, usually the entire bulk material carbonator has to be replaced.

SUMMARY OF THE INVENTION

It is therefore a first object of the present invention to create an impregnator of the type defined at the outset with which high gas release effectiveness is attained at low production and operating costs, and which is suitable for use in the food field and for producing beer, as well as a bar system equipped with such an impregnator, as well as to improve the production of beer and other beverages.

These objects are attained with not only with regard to an impregnator, a pressure compensator assembly, and a bar system, but also with regard to beer and beverage production by the use of an impregnator.

In a first aspect of the invention, an impregnator body is disposed in a mixing cell of the impregnator, into which cell a gas inlet and a liquid inlet discharge and from which an outlet for the liquid and gas mixture leads outward, the impregnator body being disposed in such a way that the flow of liquid and gas through the mixing cell must necessarily take place through the impregnator body, and the impregnator body comprises a porous material or in other words is a porous solid body. The porous solid body, or solid body that has pores, can comprise any material that has pores and a large surface area, such as sintered materials, woven, knitted, mesh or felted solid bodies, or sponge or foamed materials, or the like. A hollow fiber module comprising hollow plastic fibers, which can be fabricated in the size of a human hair, would also be conceivable. These materials are inexpensive, and particularly the sintered solid bodies can be produced with high uniformity in terms of pore size and pore arrangement, so that advantages are attained not only in terms of commercial aspects but also in terms of the quality of impregnation or carbonation of the liquid to be impregnated with a gas and in particular to be carbonated.

All the materials listed above are suitable as material for the impregnator bodies. However, it has been found that embodiments in which the impregnator body, or one of the impregnator bodies, is produced from a sponge, from foamed material or foam, or from a body that comprises hollow fibers has especially many advantages, since these materials have high porosity, with a relatively high number of pores that can be adjusted depending on the material and a relatively high average pore size and thus have large phase boundary faces with low flow resistance and adequate resistance to being washed away. In a preferred embodiment, the at least one impregnator body comprises a polyester or polyether filter foam with a pore size of 90-100 PPI (pores per inch), corresponding to a pore size of approximately 250 μm and approximately 90,000 cells/cm$^3$ (open-pore cells). Especially advantageously, the foam has the cellular structure of a reticulated filter foam, which is virtually 100% open-celled. Because of the reticulation, the cell membranes are removed virtually entirely; that is, only a skeleton remains behind. This assures a pronounced low flow resistance. The phase boundary faces are accordingly no longer located at pores that are completely surrounded by walls of material but rather at otherwise open-walled cells that are surrounded by only a skeleton of material.

For attaining an even smaller pore size, the foam in the carbonator is advantageously compressed, in particular from originally 150 mm to 80 mm in length. As a result, the foam impregnator body is compressed, and the number of cells rises to approximately 170,000 cells/cm$^3$.

With sintered materials as well, however, large phase boundary faces and great turbulence in the flow can be generated. Depending on the desired gas and liquid and on the desired composition of the starting mixture, various sintered materials with different pore sizes are available, so that the impregnator can be adapted to particular specifications by the selection of the suitable material for the impregnator body. Depending on requirements made of the impregnator body, including durability and food safety, a sintered material of glass, ceramic, plastic, or metal may be used.

Advantageously, the impregnator body is embodied as a disk that fills the diameter of the mixing tube, so that the liquid, but also the gas, must necessarily flow through the impregnator body and enters into solution at the large surface area of the pores of the solid body. It is advantageous here that this solid body can be introduced easily into the mixing cell but also removed easily from it again, so that both economical production and maintenance of the impregnator at the intervals prescribed by hygiene laws are easily possible. Bulk material is thus effectively prevented from washing away, without the high cost, complicated engineering, and complex assembly of a tubular sieve carbonator.

However, it would also be conceivable to provide the impregnator body with a mounting—for instance of plastic—and thus to form an impregnation cartridge that fills the diameter of a mixing cell that is advantageously embodied as a mixing tube.

If it proves necessary for the impregnator body to be additionally fixed in the mixing cell, then suitable fixation means may be provided, such as a perforated plate or a lattice, which holds the impregnator body in position and with which the impregnator body is optionally compressed.

A further advantageous refinement pertains to a high-frequency or ultrasonic vibrator, which acts on the interior of the mixing cell and thus serves as a supplementary impregnator or impregnation reinforcing device. The vibrator could be mounted on the wall of the mixing cell, for instance, or have ultrasound generators distributed over the entire circumference of the mixing cell and/or an ultrasound unit disposed in the mixing cell. As a result of the oscillations generated per high-frequency vibration and the resultant cavitation, high turbulence and hence short transportation courses in the mass transfer are attained in the mixing cell. It is especially advantageous that the use of ultrasound is done at the pressure prevailing in the mixing cell of the carbonator or impregnator (such as 3 to 5 bar) and with the medium flowing through it.

One method for releasing gas in a liquid with the aid of ultrasound is described in European Patent Disclosure EP 0 661 090 B1.

The invention is not limited to an impregnator with an impregnator body. On the contrary, a plurality of impregnator bodies may be connected in series in the mixing cell. Each impregnator body or some of the impregnator bodies may comprise different materials, so that the mixing properties of the impregnator can be adapted even better to the particular liquid or gas or desired starting composition.

Also advantageously, a head piece that seals off the gas and liquid infeed side of the mixing cell from the surroundings is provided that is provided with one connection for a liquid infeed line and one connection for a gas infeed line. The impregnator can thus be installed in existing systems in a simple way.

Preferably, the impregnator is produced as a one-piece end product, such as a one-piece injection-molded component with an integrally welded impregnator body. Alternatively, the impregnator may instead be constructed such that it can be broken down into its individual parts and cleaned, which also makes easy replacement of the impregnator body or impregnator bodies possible. Especially advantageously, the entire impregnator (except for the impregnator body or bodies) or at least the housing of the mixing cell is made from a plastic that does not swell and that can be shaped with sufficiently precise tolerances.

If the head piece is screwed to the mixing tube, the gas inlet discharges centrally into the mixing tube, and the liquid channel is eccentric or annular, the gas outlet may for instance be provided on a truncated tube screwed onto the head piece in the interior of the mixing tube.

For mixing in a second gas, a second gas infeed line connection can also be provided on the mixing cell. It would be equally conceivable for that purpose to connect a plurality of impregnators in series in such a way that the outlet of the preceding impregnator communicates with the liquid inlet of a downstream impregnator, in order to create an impregnating system for mixing a liquid with a plurality of gases. Such impregnators with a plurality of gas connections can advantageously be used for mixing a beer precursor product that does not contain $CO_2$ or contains only little $CO_2$ with $CO_2$ and nitrogen. Nitrogen is added to beers—at least in foreign countries that do not have the German Reinheitsgebot or purity law—for the sake of better foam holding, while conversely $CO_2$ has to be added to beer precursor products that contain no or only little $CO_2$.

Further advantageous uses of the impregnator according to the invention are obtained upon mixing a beverage precursor product with flavorings, since flavorings or fragrances are often in gaseous form. This use is especially suitable for substance or materials that are not durable for very long once they are mixed or when they are at low concentrations and which therefore have to be freshly prepared on an ongoing basis. For instance, an apple juice could be mixed with cherry flavor or the like. Another advantageous use has already been addressed in conjunction with the impregnator that has two gas inlets. Naturally, impregnators according to the invention that have only one gas inlet can also be especially advantageously used for mixing a noneffervescent or only slightly effervescent beer precursor product, or one contains no or only little $CO_2$, with $CO_2$. On the other hand, they can also be used to mix beer or a beer precursor product with nitrogen.

In a further aspect of the invention, a gas inlet valve and a liquid inlet valve are provided, which are arranged for opening and closing the gas and liquid inlets in accordance with the magnitude of a pressure drop from the inlet side to the mixing cell, and the gas inlet valve has a gas inlet closing element, disposed in a gas inlet channel, and the liquid inlet valve has a liquid inlet closing element, disposed in the liquid inlet channel, and the gas inlet closing element and the liquid inlet closing element are coupled to one another in such a way that the gas inlet valve opens the gas inlet to a predetermined degree of opening, depending on the degree of opening of the liquid inlet at the time.

By way of coupling the degree of opening of the gas inlet with the degree of opening of the liquid inlet, in accordance with the invention, it is thus successfully possible for various tapping speeds to establish a mixture ratio suitable for the impregnation process in the interior of the mixing cell. Depending on the liquid and gas selected and on the optimal ratio of the two to one another at the applicable pressure, the coupling may increase linearly or degressively or progressively with the pressure. If the liquid inlet opens widely, then the gas inlet opens correspondingly widely as well, and hence the necessary carbonic acid for impregnating a carbonic acid-free beer precursor product, for instance, flows in. If the degree of opening of the liquid inlet is reduced, conversely, then the degree of opening of the gas inlet lessens accordingly, so that once again, a mixture ratio of gas and liquid that is suitable for the impregnation process in the mixing cell is established.

In this way, it is successfully possible to compensate both for the effects of pressure fluctuations on the mixing cell side on the ratio of the inflowing gas to inflowing liquid and for the effects of pressure fluctuations on the liquid inlet side. This is because, if the pressure in the mixing cell drops, the liquid inlet closing element reduces the degree of opening of the liquid inlet, and thus the gas inlet closing element coupled with it reduces the degree of opening of the gas inlet accordingly. The same is true if the pressure rises in the mixing cell; then the gas inlet closing element either reduces the degree of opening to the same ratio or in obedience to the principles (mixture ratio course over the pressure) suitable for the particular impregnation process, in the same way as is predetermined by the liquid inlet closing element.

Conversely, if pressure surges occur on the liquid inlet side, surges that as addressed above can be caused by the use of piston pumps, then the liquid inlet valve will open the liquid inlet to a defined degree, as a function of the pressure drop existing at the particular time from the liquid inlet to the mixing cell, and via the coupling of the gas inlet valve, the gas inlet is likewise opened correspondingly wide.

Advantageously, the liquid inlet closing element is prestressed toward the liquid inlet side and is joined integrally to the gas inlet closing element, so that a displacement of the liquid inlet closing element is transmitted to the gas inlet closing element. The unit thus formed can be embodied on the order of a piston slide, if the mixing cell head or the head piece of the impregnator is constructed like a T element, or in other words if the liquid inlet and the gas inlet are aligned with one another. It is thus possible in a structurally simple way to define both the inflowing liquid flow rate and the inflowing gas flow rate as a function of the pressure drop from the liquid inlet side to the mixing cell.

Alternatively, an electrical coupling of the closing elements could also be provided. In addition, a piston slide unit on the order of a multiposition valve, comprising the gas inlet closing element and the liquid inlet closing element, could also be used in a mixing head in which two parallel inlet channels lead into the interior of the mixing cell. For that purpose, a closing position could for instance be provided in which the piston slide seals both the gas inlet channel and the liquid inlet channel, as well as an opening position, in which the piston slide is thrust with one or more openings penetrating it in front of both the liquid inlet opening and the gas inlet opening, so that the applicable opening is uncovered. However, in this arrangement one additional provision is necessary in order to actuate the piston slide as a function of the pressure drop from the liquid inlet side to the mixing cell, such as a suitable bypass line to a face end of the piston slide from the liquid inlet side, and a prestressing device acting on the other face end of the piston slide. However, that construction is relatively complicated.

What is therefore preferred is a mixing head in the shape of a T, with an aligned liquid inlet channel and gas inlet channel, in which the piston slide, formed of the liquid inlet closing element and the gas inlet closing element, is seated directly in the liquid inlet channel and the gas inlet channel and, by a displacement in the direction toward the gas inlet opens both the gas inlet and the liquid inlet to the desired extent. Conversely, a displacement toward the liquid inlet closes both the gas inlet and the liquid inlet.

In a first embodiment, this response to the pressure drop from the liquid inlet to the mixing cell could be accomplished by providing that the gas inlet closing element is a piston, which widens conically toward the gas infeed side and which is located in a likewise conically widening gas inlet channel portion and communicates with the liquid inlet closing element via a piston slide portion. The liquid inlet closing element can be a slide that tapers conically toward the liquid infeed side and is located in a liquid infeed, likewise tapering conically toward the liquid infeed side, and that is prestressed, on its side toward the liquid infeed side, toward the liquid infeed.

Because of its simple and more-economical construction, however, an embodiment is preferred in which the liquid passage extends from the liquid infeed side into the mixing cell through the liquid inlet closing element, and the gas infeed is effected through the gas inlet closing element. To that end, the liquid inlet closing element may be a hollow body surrounded on multiple sides and open toward the liquid infeed side, and in the walls that surround the hollow body on multiple sides, at least one passage opening for the liquid is provided. In the closing position, in which the liquid inlet closing element fills the liquid inlet blocking portion, no passage of liquid therefore occurs. However, if the liquid inlet closing element is put in an opening position, in which it protrudes into a volume located on the mixing cell side, the liquid passage is at least partially uncovered, and the beverage precursor product flowing into the hollow body from the liquid infeed side can flow into the mixing cell.

The gas inlet closing element can in this case as well be provided as a conical slide element in a conical gas inlet channel. However, it is advantageous for a hollow body to be provided also on the gas inlet side, as a gas inlet closing element, but this hollow body is open toward the mixing cell and in a closing position fills the gas infeed channel, and in an opening position it is thrust so far into a volume on the gas infeed side that at least one gas passage opening for the gas is uncovered, through which the gas can flow from the gas infeed side into the mixing cell interior.

It is understood that in the event that the force acting from the gas side on the piston slide is greater than the force acting from the liquid side, it is also possible to provide the hollow body on the liquid side with an opening toward the mixing cell and with closable liquid passages to the liquid infeed side, if the gas inlet closing element is at the same time open toward the gas side and is closable toward the mixing cell.

In this respect, a sealing element is advantageously provided between the gas inlet closing element and the gas inlet blocking portion.

It is also advantageous if the liquid passages are bores distributed over the wall of the liquid inlet closing element, or in other words are relatively small in proportion to the diameter of the liquid inlet blocking portion but in turn are present in high numbers. The same is true for the gas passages. The ratio of the diameter of the closing element to the passage bore is advantageously over 1:10 and preferably over 1:20. In this way, the number of passage bores available for the gas and liquid passage can be allocated precisely, to suit the position of the valve piston slide.

It is especially advantageous in this respect if the liquid and/or gas passage bores are provided in the form of a chain of bores located spirally around the side wall of the respective closing element. This is because in that case, the available number of bores for the passage of liquid and gas does not increase or decrease suddenly, but instead increases and decreases incrementally upon displacement of the piston slide, by one bore each, so that the desired gas and liquid flow rate can be adjusted still more precisely as a function of the pressure drop from the liquid inlet side toward the mixing cell.

Additional advantageous refinements will become apparent from the following description.

Within the scope of the invention, it is understood to be possible to combine the various characteristics freely, to the extent that this appears useful. It is understood that the aforementioned characteristics and those still to be explained below can be employed not only in the combination indicated but also in other combinations or on their own, without departing from the scope of the invention. Nor is the invention restricted to the uses described herein.

For instance, the use of any suitable impregnator for mixing beer with nitrogen or for mixing a beverage precursor product with gaseous flavorings or for mixing beer precursor products that contain no $CO_2$ or only little $CO_2$ with $CO_2$ could be made the subject of an independent patent application.

BRIEF DESCRIPTION OF THE DRAWINGS

Individual advantageous embodiments of the invention will be described in further detail below in conjunction with the accompanying drawings. Shown are.

DETAILED DESCRIPTION OF THE PREFERRED EMBODIMENTS

Figure 1:
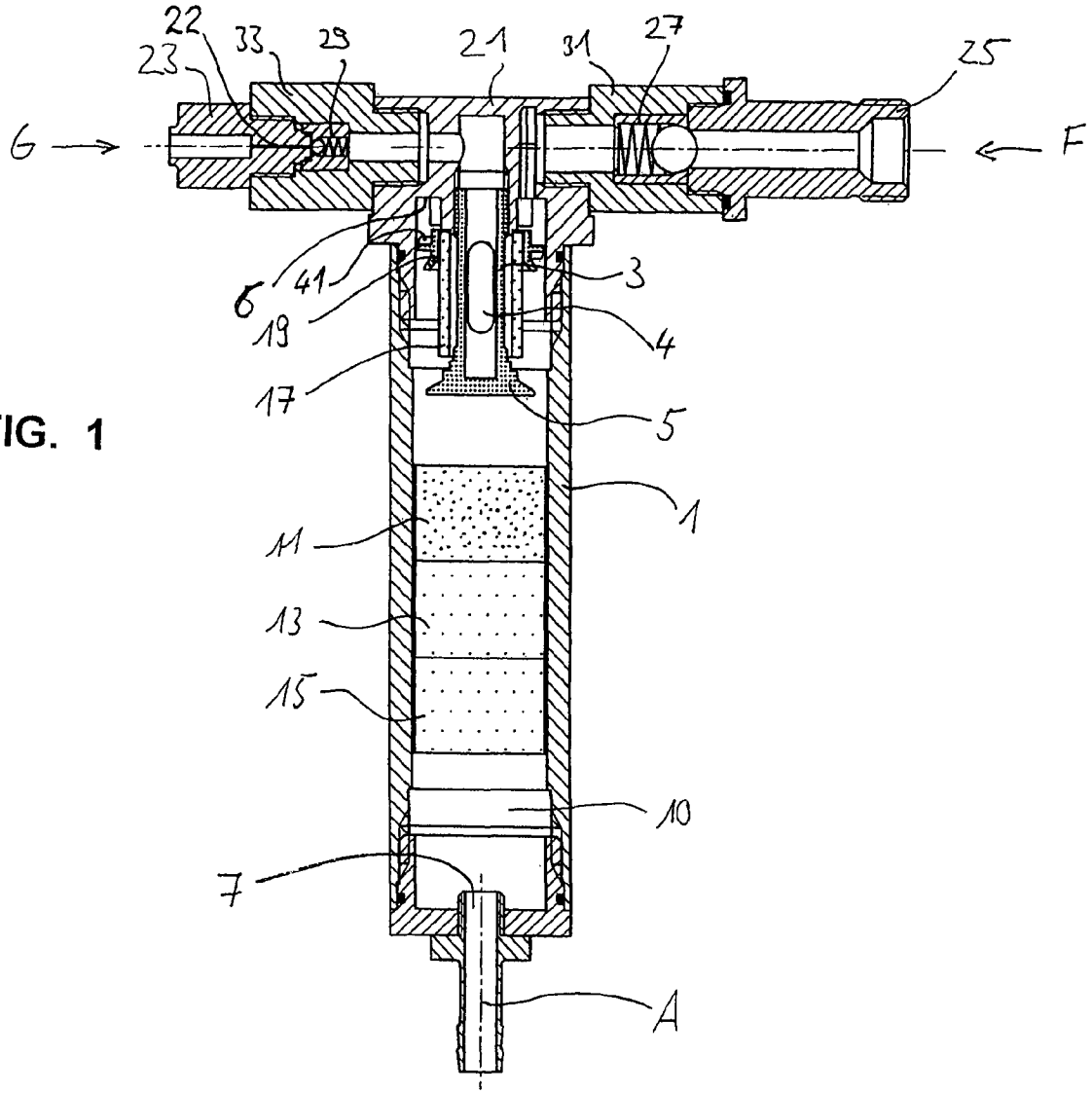
FIG. 1, a sectional view of a solid body impregnator in accordance with a first embodiment of the present invention.

First, reference will be made to FIG. 1. Reference numeral 1 designates a tubular mixing cell. In the mixing cell 1, disklike impregnator bodies 11, 13, 15 are press-fitted in series and in succession, so that the liquid flowing through the mixing cell 1 and the gas, or the already premixed gas-liquid mixture, flowing through the mixing cell 1 must pass through the impregnator bodies 11, 13, 15 and thus enter into solution at the surface of the pores marked with dots. The first impregnator body 11 in order from the infeed side is made of a sintered material with finer pores than the two impregnator bodies 13, 15 that follow it.

The impregnator bodies are adjoined by a calming portion marked 10, in which the gas-liquid mixture emerging as a turbulent flow from the outlet-side impregnator body 15 is calmed to a laminar flow before exiting the impregnator through an outlet opening 7 and being conducted for instance to a dispensing tap in the dispenser system.

The outlet tube 7 is provided in a cap that is screwed onto the mixing tube 1 and is sealed off from the mixing tube 1 by an O-ring. On the inlet side, the mixing tube 1 is likewise closed with a screwed-in component, which is a head piece 21, and sealed off with an O-ring.

The gas infeed G on one side—at the left in the drawing—and the liquid infeed F on the other—at the right in the drawing—can be connected to the head piece 21. To that end, the head piece 21 is penetrated by a gas infeed channel, which discharges into the mixing cell via a truncated tube 3, and a liquid passage channel, which discharges into the mixing cell 1 eccentrically at a point marked 6. Both on the gas infeed side and the liquid infeed side, threaded bores are provided in the head piece, and respective connection pieces 33, 31 are screwed into them, each connection piece receiving a respective check valve 29, 27, with which the gas and liquid infeed channels are secured against a reverse flow from the mixing cell 1. A connection tap 23 is screwed in turn into the connection piece 33 on the gas infeed side and can be connected in plug-in fashion to a gas infeed line, while conversely on the liquid infeed side, a connection tap 25 is screwed into the connection piece 31 there, and a hose for liquid can be slipped onto this connection tap with a suitable plug part. The gas infeed channel, in the region of the connection tap 23 on the gas infeed side, has a cross-sectional constriction marked 22, which acts as a pressure limiting nozzle 22. With the pressure limiting nozzle 22, it is assured that the gas pressure will not become so high that the gas positively displaces the liquid in the mixing cell; the gas pressure and furthermore the mixing operation nevertheless remain adequately controllable.

The truncated tube 3 mentioned above, into which the gas infeed channel that penetrates the head piece discharges centrally, has a plate 5 or an encompassing shoulder 5 on its side facing away from the head piece 21, and on its side facing toward the head piece 21 it is screwed into the gas infeed channel, which is provided with a female thread and extends centrally to the center axis A of the mixing tube. Between the plate 5 and a corresponding encompassing stop on the head piece 21, a preimpregnation sleeve 17 is fastened in place. The preimpregnation sleeve 17 is sealed off from the head piece on the head piece side by a sealing ring, embodied as an inner shoulder on a bucket wheel 19, and is sealed off on the other end against the plate 5 of the truncated tube 3; in the drawing, the truncated tube 3 is shown in a state in which it has not yet completely entered the threaded bore in the head piece. The bucket wheel 19 has guide buckets over its circumference, which impart a turbulent spiral flow to the liquid discharging into the mixing cell 1 at the liquid inlet 6. The truncated tube 3 that forms the gas inlet into the mixing cell 1, conversely, on its circumferential surfaces has two oblong slots 4, through which the gas can pass from the gas infeed channel through the preimpregnation sleeve 7 into the mixing cell 1.

The mixing operation thus proceeds as follows:

From a connected gas infeed G, the gas is carried via the gas infeed channel that penetrates the head piece 21 to the oblong slots 4 in the truncated tube 3 and emerges there. The gas that has emerged necessarily diffuses through the preimpregnation sleeve 17 received in sealed fashion on both ends, and as a result the gas flow entering as a gas stream is converted into a large-area, turbulent gas jet, distributed over the surface toward the mixing cell 1 of the preimpregnation sleeve 17, at the surface of the porous material from which the preimpregnation sleeve 17 is formed, before the gas flow enters the mixing cell 1.

Simultaneously, from a connected liquid infeed F, liquid passes eccentrically to the center axis A of the mixing tube through a liquid infeed channel, which penetrates the head piece 21, and enters the mixing cell 1 at the point 6. There, the liquid flow meets the guide buckets 41 of the bucket wheel 19 and is subjected by them to a swirl in the direction crosswise to the inflow direction, so that the inflow of liquid is also initially braked and made turbulent. Because the preimpregnation stage 17 comprises an only semipermeable, hydrophobic material, the liquid inflow cannot, however, reach as far as the gas outlet openings 4. A first premixing of the turbulent gas inflow, distributed over a large surface area, and of the turbulent liquid inflow in the mixing cell 1 thus takes place in the inlet region in the vicinity of the head piece 21.

The preimpregnation stage 17 and the prevortexing stage (bucket wheel 19) could also be omitted. Alternatively to the preimpregnation stage 17 and the prevortexing stage (bucket wheel 19), an ultrasonic vibrator could also be provided, in order to bring about preimpregnation. As an alternative to that, the ultrasonic vibrator could also be downstream of the impregnator bodies 11, 13, 15 described below. Instead of an ultrasonic vibrator, a high-frequency vibrator could also be provided. Within the scope of the invention, "high-frequency" is understood to mean frequencies above 12000 Hz.

The flow, comprising the gas already premixed with the liquid, in its further course enters the first impregnator body 11, which comprises a fine-pore material. The surface of the porous solid body impregnator body 11 is formed not only by its outer surface but also by the surface of the pores in the interior of the impregnator body 11 and is therefore very large in area, so that high turbulence in the flow passing through occurs, along with dissolution of the gas in the liquid because of the large phase boundary face. The first impregnator body 11 can be adjoined by two further impregnator bodies 13, 15, with which the fine adjustment of the mixture ratio of the gas-liquid mixture is done. The impregnator bodies 11, 13, 15 are made in disklike shape from a porous sintered material and are stuffed into the mixing tube 1, so that they close off its diameter completely, and the incoming flow is forced to diffuse through the material comprising the impregnator bodies 11, 13, 15. The two impregnator bodies 13, 15 have a lesser number of pores than the impregnator body 11 located farthest upstream.

The sintered solid bodies 11, 13, 15 may, however, as has recently been demonstrated, also be replaced by foam impregnator bodies, and in particular by polyester or polyether filter foams, preferably reticulated.

After the passage through the main impregnation stage, which is formed by the impregnator bodies 11, 13, 15, the gas-liquid mixture reaches a calming zone 10, which is separated from the rest of the mixing cell 1 by the impregnator bodies 11, 13, 15 and in which the turbulent flow is braked and converted into a laminar flow that can emerge from the mixing cell via the outlet opening 7.

Figure 2A:
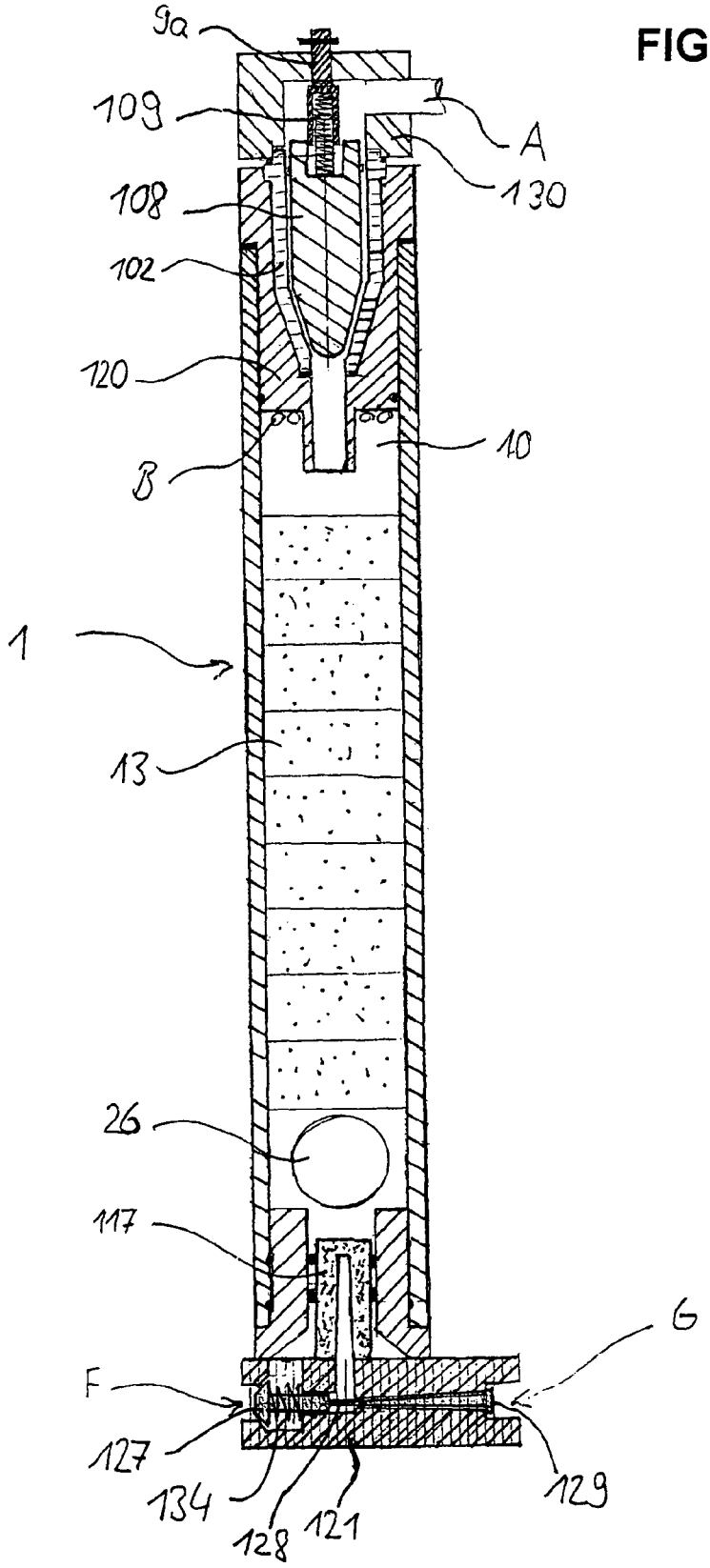
FIG. 2*a*, a sectional view of an impregnator in a further embodiment of the present invention.

FIG. 2*a* shows an embodiment of the impregnator of the invention in which the impregnation is done by the same principle as in the impregnator of FIG. 1, but now on the inlet side of the mixing cell a valve assembly is provided, in which a gas inlet closing element 121 and a liquid inlet closing element 127 are coupled, while conversely on the outlet side of the mixing cell, a pressure compensator assembly is provided. Even under highly fluctuating pressure conditions and mass throughputs, a constantly good outcome of impregnation can be attained, and at the same time the dispensability of the beverage produced can be assured. The valve assembly on the inlet side of the mixing cell and the pressure compensator assembly on the outlet side of the mixing cell supplement one another in terms of absorbing fluctuations in pressure or quantity both at the inlet side and on the dispensing tap side. This highly important, especially for gassing beer with $CO_2$ in a bar, since beer is a beverage that starts foaming readily. However, if the beer or beer and gas mixture in the dispenser system rips open, forming foam, it is no longer possible to achieve a satisfactory outcome at the tap.

The liquid flows through the liquid inlet F and the gas flow through the gas inlet G into the mixing head 121, and there it is carried onward into the mixing cell 1, in which the actual impregnation operation takes place. The gas inlet closing element 129 is in the shape of a piston that tapers to a point conically toward the gas inlet G, while the liquid inlet closing element 127 is a piston that tapers on the order of a truncated cone toward the liquid inlet, and the two closing elements 127, 129 are joined into a valve slide unit by way of a connecting portion 128 embodied in needle-like fashion in some portions. The liquid inlet closing element 127 is prestressed counter to the liquid inlet by an annular spring 134, which is braced on one end on the back side of the liquid inlet closing piston 127 and on the other on a wall of the liquid inlet channel and surrounds the connecting portion 128.

If a force, which is greater than the contrary force resulting from the internal pressure of the mixing cell on the inside of the liquid inlet closing element 127, the spring force, and the gas pressure on the gas inlet closing element 129, is exerted by the inflowing liquid on the liquid inlet closing element 127, then the liquid inlet closing element 127 opens the liquid inlet, and—via the connecting portion 128—the gas inlet closing element 129 opens the gas inlet. The conical course of the gas inlet closing element 129 and of the gas inlet blocking portion surrounding it is adapted to the frustoconical course of the liquid inlet closing element 127, and of the liquid inlet blocking portion surrounding it, in such a way that for every pressure drop between the liquid inlet and the mixing cell, the optimal ratio of the flow rate of gas to the flow rate of liquid for the impregnation operation is established. The gas infeed G takes place through a preimpregnation body 117, along which the liquid infeed F flows annularly. To compensate for pressure fluctuations on the inlet side of the mixing cell, a compressible balloon 26 may also be provided, as a volumetric compensation body.

The impregnator is in an upside-down position; that is, the mixing head 121 is located at the bottom, and the mixing cell 1 with the impregnator bodies 13 has a vertically upward-oriented flow course. Any gas bubbles B still present in the mixing cell 1 after passage through the impregnator bodies 13 can rise in this way and be intercepted in the calming zone 10 of the mixing cell 1, without entering the pressure compensator assembly at the mixing cell outlet and thereby causing turbulence at the dispensing tap.

As an alternative to this, the mixing head 121 may also be disposed at the top. This is because even better results are then attained, as has been demonstrated. This is due to the fact that the carbonated liquid, before exiting (at the bottom) from the mixing cell, is still in a kind of calming tub. Moreover, unbound gas, especially $CO_2$, in the liquid has the tendency to rise, or in other words to ascend backward in the direction of the proportional valve, so as to be bound into liquid there.

If the liquid or beverage, impregnated for instance with carbon dioxide in the impregnation or mixing cell 1, and in particular the now-carbonated beer, reaches the inlet of the pressure compensator assembly, then it presses with the operating pressure in the mixing cell 1 against the throttle restriction 108. This pressure is counteracted by the prestressing force of the spring 109, which presses on the back against the throttle restriction 108 and which can be adjusted via an adjusting screw 9*a*. The pressure on the outlet side A also acts counter to the working pressure in the mixing cell. If the bartender opens the tapping line or dispensing tap adjoining the outlet side A, the pressure on the outlet side A drops, and the throttle restriction 108 is forced upward far enough that the impregnated liquid in the mixing cell 1 can flow through the pressure compensator assembly to the dispensing tap.

The gap width between the sleeve 102 and the throttling tap 108 determines the flow speed and hence the flow rate and at the same time has an influence on the pressure loss at the pressure compensator assembly. If the bartender wants a large quantity of impregnated beer ready to tap, for instance, then the pressure on the tapping side drops sharply, and the throttle restriction 108 opens over a wide gap width. If the pressure on the tapping side drops less sharply (because the bartender is asking for a smaller quantity), the throttle restriction 108 opens over a lesser gap width.

The pressure compensator assembly acts in this process on the inlet valve assembly as well, since with the pressure compensator assembly, pressure changes in the mixing cell that result from the different tapping speeds are buffered, and as a result, the gas metering problems that have to be dealt with via the inlet valve assembly at different pressure drops between the liquid inlet and the mixing cell are lessened, since the pressure fluctuations become less.

Figure 2B:
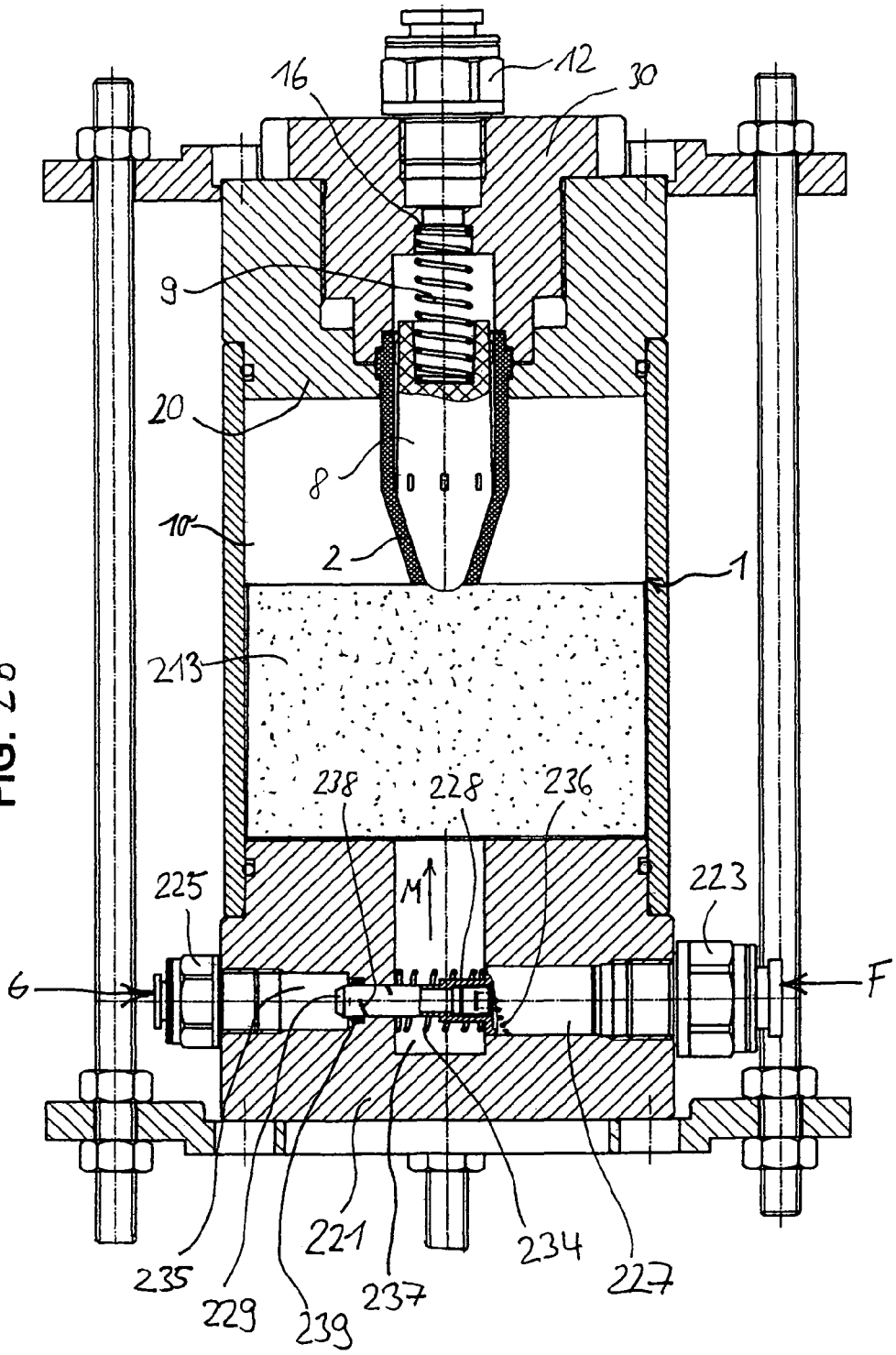
FIG. 2*b*, a sectional view, corresponding to FIG. 2*a*, of a further embodiment of the present invention.

A further embodiment of the invention is shown in FIG. 2*b*. The throttle restriction 108 shown in FIG. 2*a* and correspondingly the sleeve 102 are somewhat slimmer than the respective body 8 and sleeve 2 shown in FIG. 2*b*, so that the friction losses overall are somewhat less. Moreover, the sleeve 102 is received entirely in the stopper 120 that closes off the mixing cell on the outlet face end, to which stopper the outlet piece 130 is flanged with an outlet A extending to the side and is sealed off from the sleeve 102 with an O-ring. The stopper 120 is also sealed off with an O-ring and a flat seal, inserted at the face end, from the side walls of the mixing cell.

The pressure compensator assembly thus has a line segment 2, 30, 12, which is screwed into a (female-) threaded flange 20 of an impregnator that forms the closing wall of the mixing cell 1. The line segment 2, 30, 12 has an inlet-side sleeve 2, which is press-fitted into a corresponding receiving opening in the wall of the threaded flange 20 that closes off the mixing cell on the outlet face end. A throttle restriction or throttle tap 8 is disposed in the sleeve 2; it comes to a point toward the inlet side and thus corresponds to the widening at that location of the sleeve 2. Acting on the tap 8 is a spring 9, which forces the tap 8 toward the inlet to the sleeve 2, so that the inlet of the sleeve 2 or line segment 2, 30, 12 is closed when no pressure is acting on the tap 8 from the inlet side. To that end, the spring 9 is braced on an annular shoulder 16 in the tubular piece 30, and the tubular piece 30 is screwed in sealed fashion into the female thread of the threaded flange 20 and keeps the sleeve 2 in the receptacle in the threaded flange 20 and with it forms one continuous line that is sealed off from the surroundings. On the outlet side, a connection piece 12 is inserted into the tubular piece 30, so that the impregnator can be connected via the pressure compensator assembly to the bar line.

The pressure compensator assembly in FIG. 2*b* is thus distinguished from the embodiment shown in FIG. 2*a* essentially in that the beverage emerges here through the annular spring 9 and then flows vertically upward without kinks in the flow, while in FIG. 2*a*, conversely, a lateral beverage outlet connection is provided. Although the inlet valve assembly is more fundamentally different from the embodiment shown in FIG. 2*a*, nevertheless as in the pressure compensator assembly, similar reference numerals are used as in FIG. 2*a* for components that are functionally similar or identical.

Figure 3:
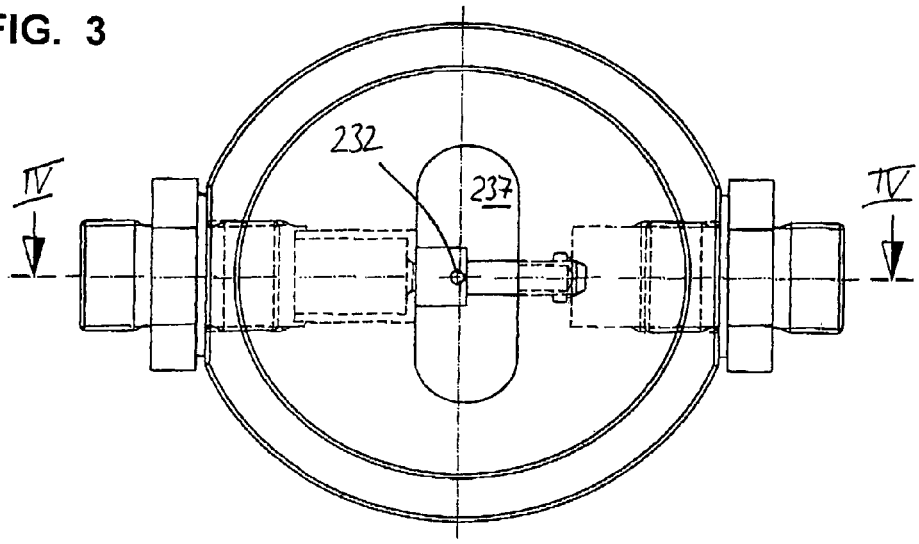
FIG. 3, a sectional view along the axis of the gas and liquid inlet channel in FIG. 2*b*, perpendicular to the sheet direction.

The liquid inlet closing element 227 is again braced against the liquid inlet pressure via an annular spring 234, which surrounds a connecting portion 228 that combines the liquid inlet closing element 227 with the gas inlet closing element 229 to make a piston slide unit that can be displaced in the aligned gas inlet channel and liquid inlet channel. The hollow cylinder that forms the liquid inlet closing element 227 is opened toward the liquid inlet and is closed toward the mixing cell by an end wall, while conversely the hollow-cylindrical needle that forms the gas inlet closing element 229 is closed toward the gas infeed side by an end wall and, has a plurality of openings, not shown in FIG. 2*b* (see reference numeral 232 in FIGS. 3 and 4), toward the mixing cell 1 that are distributed over its circumference. The hollow cylinder that forms the liquid inlet closing element 227 is received with little play in a bore forming a liquid inlet blocking portion, and the hollow-cylindrical needle forming the gas inlet closing element 229 is received with little play in a bore that forms a gas inlet blocking portion; a gas seal 239 is provided between the bore and the hollow-cylindrical needle, and the two bores are aligned with one another.

Reference numeral 236 identifies a chain of liquid passage openings, spirally surrounding the circumferential side wall of the liquid inlet closing element 227, and reference numeral 238 identifies a chain of gas passage openings, spirally surrounding the circumferential side wall of the liquid inlet closing element 227. Now, if a suitably high pressure is exerted from the fluid inlet side on the liquid inlet closing element 227, then the entire piston or valve slide assembly shifts to the left in the drawing, causing the liquid inlet closing element 227 to protrude, with its sides toward the mixing cell, into an open volume 237. As a result—depending on the liquid pressure, the gas pressure, and an internal pressure in the mixing cell that are applied—at least some of the liquid passages 236 are opened, so that the flow rate of the liquid flowing into the mixing cell is adjusted accordingly.

The gas flow rate flowing into the mixing cell is established in a similar way: When the gas inlet closing element 229, via the connecting portion 228, is shifted to the left, it protrudes with its end toward the gas infeed into a free volume 235; some of the gas passage bores 238 corresponding to the opened portion of liquid passages 236 are uncovered, so that for the flow rate of each inflowing liquid, the optimal gas flow rate to suit the impregnation operation is established.

Between the sleeve 2 and the head piece 221, an impregnator body 213 can be press-fitted into place, through which the flow has to pass. The impregnator body 213 is dimensionally stable to such an extent that no further securing means are needed; for instance, it comprises a dimensionally stable hollow fiber module. Except for the calming zone 10, it completely fills the mixing cell 1. Once again, it has been demonstrated that the impregnator is best operated in a position in which the mixing head is at the top, or in other words a position rotated by 180° compared to the drawing.

Figure 4:
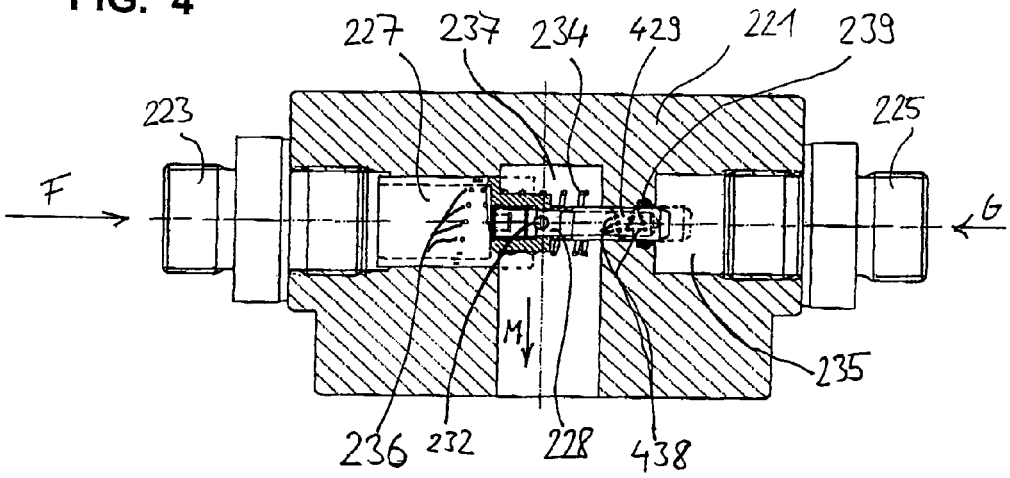
FIG. 4, a sectional view along the line IV-IV in FIG. 3 of a slightly modified form of the embodiment of the invention shown in FIG. 2*b;*
Figure 5:
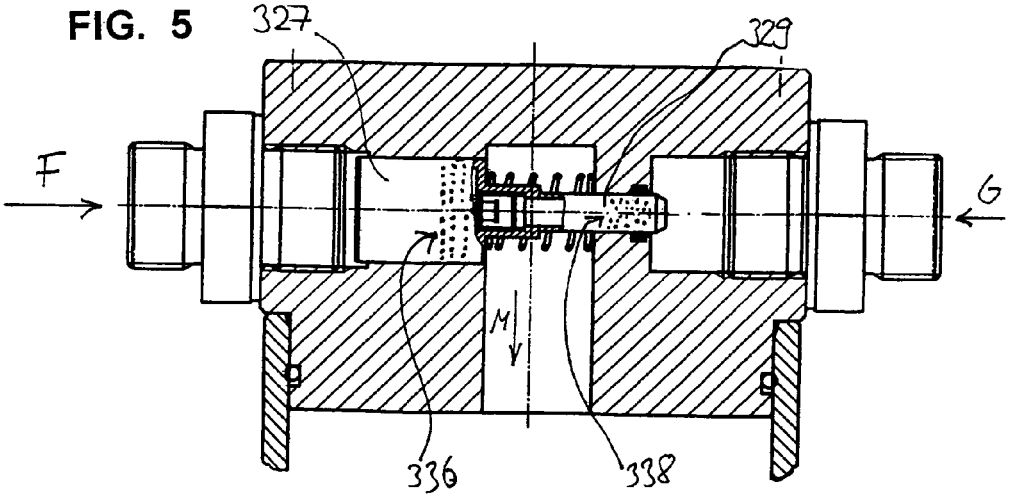
FIG. 5, a view corresponding to FIG. 4 of a slight modification of the embodiment shown in FIG. 2*b;*

FIGS. 4 and 5 each show modifications of the embodiment shown in FIG. 2*b*.

In FIG. 4, section lines shows an open position of the valve slide, comprising the liquid inlet closing element 227, the connecting portion 228, and the gas inlet closing element 429. It can be seen that the chain of gas passages 438 extends with a slight slope around the lateral circumferential wall of the gas inlet closing element 429. Per unit of length by which the valve slide is displaced into the open position, a greater number of gas passages is opened than in the embodiment shown in FIG. 2*b*. Therefore the embodiment shown in FIG. 4 can be used for instance for producing a different beverage from that of the embodiment shown in FIG. 2*b*, for instance for producing wheat beer from a carbonic acid-free wheat beer precursor product and carbon dioxide in contrast to the production of pale beer from a carbonic acid-free barley beer precursor product and carbon dioxide.

In the embodiment shown in FIG. 5, conversely, the entire circumferential side walls of both the liquid inlet closing element 327 and the gas inlet closing element 329 are perforated with passages 336 and 338, respectively.

Figure 6:
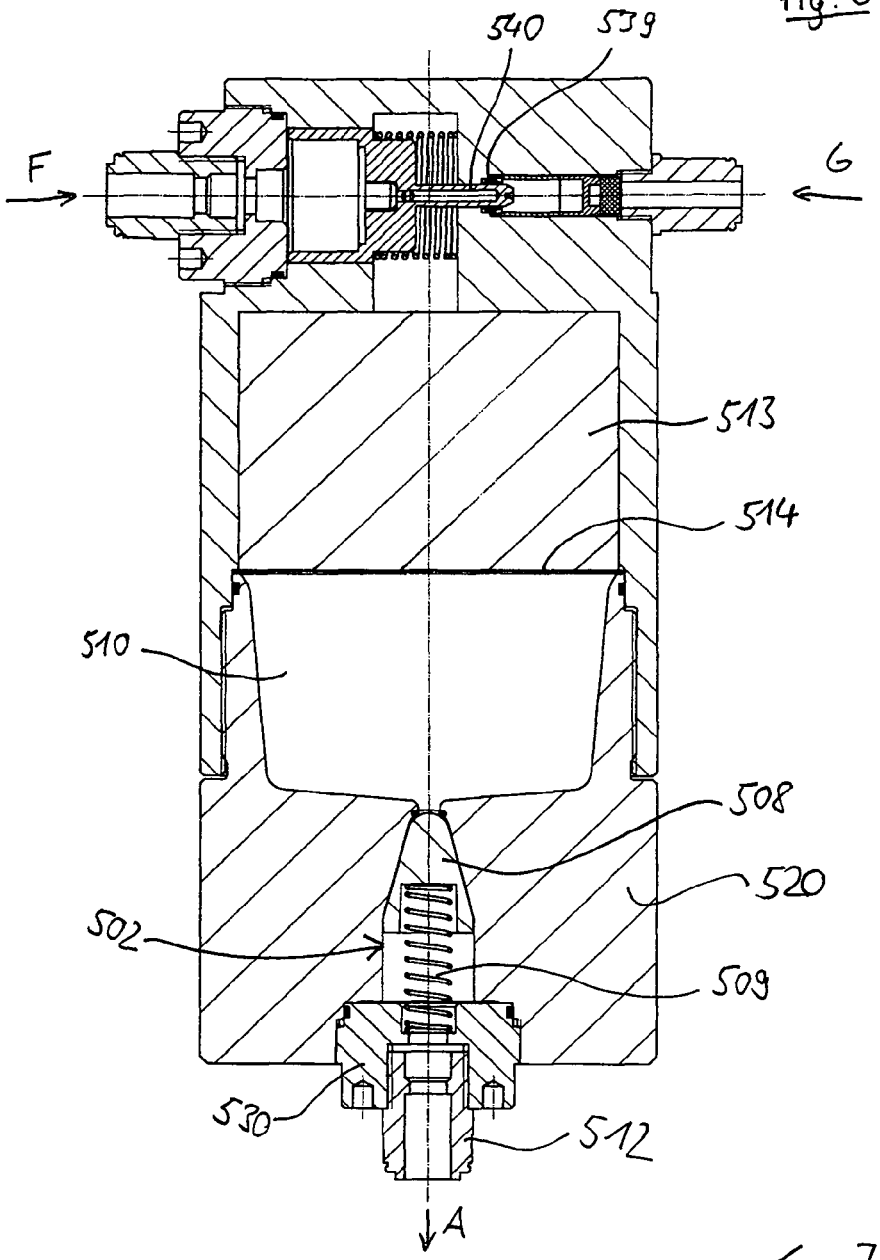
FIG. 6, a sectional view of an impregnator in a further embodiment of the invention.
Figure 7:
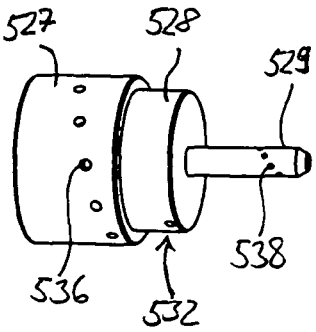
FIG. 7, a perspective view of a valve slide in FIG. 6.

FIG. 6 shows a further embodiment of the impregnator of the invention, and FIG. 7 shows the valve slide of this impregnator, the slide comprising the liquid inlet closing element 527, the connecting portion 528, and the gas inlet closing element 529. Functionally similar or identical parts have been identified with similar reference numerals.

The gas passages 538 extending as a chain around the circumference of the gas inlet closing element 529 have a diameter of 0.2 mm; only the first gas passage on the side of the gas inlet is somewhat larger, that is, in the embodiment shown here, 0.3 mm. By comparison, the liquid passages 536 disposed as a chain around the circumference of the liquid inlet closing element 527 have a diameter of 2.2 mm. The diameter ratio is thus in a range from 1:9 to 1:11, which overall appears to be suitable for beer production with proportional valves for impregnators of the type according to the invention.

The gas flows through the gas passages 538 into an inner bore 540, which is shown in FIG. 6, that extends along the gas inlet closing element 529 and otherwise is closed off from the gas inlet side. From the inner bore 540, the gas flows via two outlet openings 532 (diameter 2.2 mm) on the circumference of the connecting portion 528 into the mixing cell.

The inner bore 540 may be in contact with the liquid side but need not be. In the example shown, it is drilled from the liquid side into the valve slide, so that the latter can be fabricated in one piece. Because of the higher gas pressure (for instance, 5.5 bar compared with 4.5 bar of liquid pressure), a liquid flow to the gas inlet side is suppressed in every case, even if the slide is open, and an adequate gas flow in the direction into the mixing cell is assured in every case. Nor can the gas pass very far toward the gas inlet side, since it is carried along with the quantitatively much greater liquid flow through the liquid passages 536.

The embodiment shown in FIGS. 6 and 7 moreover differs from the embodiments shown in FIGS. 2*b* through 5 essentially only in the following aspects: In its upper region, the mixing cell is filled completely by a compressed foam solid body 513, acting as an impregnator body, which is pressed into position and held there by a perforated plate 514. The perforated plate 514 in turn is held in position on its outer circumference by a threaded stopper 520, with which the mixing cell is sealed off on the outlet side. The impregnator body is in particular of polyester or polyether filter foam with a pore size of 90 to 100 PPI (pores per inch), measured for instance by the PPI measuring method. This is equivalent to a pore size of approximately 250 μm and approximately 90,000 cells/cm$^3$ (open-pore cells). The cellular structure is that of a reticulated filter foam, or in other words is virtually 100% open-celled. Alternatively to the retention of the impregnator body by means of the perforated plate 514, an impregnator body that fills the entire mixing cell could also be provided. For the reasons already given above, the impregnator is installed in the position shown in FIG. 6, with the head piece seated at the top.

The compensator tap 508 is also disposed in the threaded stopper 520, in a suitably shaped recess 502 that conically tapers toward the mixing cell.

It is understood that deviations from the embodiments shown are possible without departing from the scope of the invention. Moreover, the characteristics of the embodiments shown may be combined arbitrarily.

For instance, in the impregnators shown in FIGS. 2*a* through 7, it is indeed especially advantageous that both impregnation solid bodies and the inlet-side proportional valve and the outlet-side pressure compensator be used. For instance, because impregnation solid bodies are used, clogging or malfunction of the pressure compensator is prevented, and by means of the inlet proportional valve, the pressure fluctuations at the pressure compensator are reduced, and vice versa. However, within the scope of the invention, embodiments of an impregnator would be equally conceivable that each have the characteristics shown only with regard to the filling of the mixing cell or inlet or outlet or in which only two of these aspects of the invention are implemented.

Besides beer and soda, with the impregnator of the invention such beverages as cider, sparkling wine, champagne, apple juice mixed with carbonated water, and cola can be produced by carbonation from a suitable precursor product that is low in carbonic acid or is carbonic acid-free. As an alternative to the coupling of the gas inlet closing element and liquid inlet closing element shown in FIGS. 2*a* through 7 and claimed in claims 11 through 20, within the scope of the invention control or regulation of an impregnator having the characteristics of the preamble to claim 21 may also be provided, with which the $CO_2$ content in the beverage generated with the impregnator of the invention is regulated by way of the inlet-side gas pressure as a controlling variable. For instance, if one wishes to have less $CO_2$ in the beverage than what is on hand at the moment, the gas pressure is reduced, for instance from 5.5 bar to 5 bar. If more $CO_2$ in the beverage is wanted, then the gas pressure is increased, for instance to 6 bar. Thus the desired, beverage-specific $CO_2$ content can always be adjusted via the gas pressure, although also always as a function of the liquid pressure at the time. The higher the liquid pressure, the lower is the $CO_2$ concentration in the beverage produced, if the gas pressure stays the same. To obtain the same $CO_2$ concentration in the beverage produced when the liquid pressure is increased, for instance from 5.5 bar to 6 bar, the gas pressure would have to be corrected upward as well, until the ratio is again correct. The $CO_2$ concentration in the beverage produced can be measured, and the gas pressure can be set in accordance with a suitable regulating algorithm. When the liquid pressure is known, the suitable gas pressure may, however, also be read off from a performance graph of the particular impregnator and the particular beverage and adjusted accordingly.

The invention claimed is:

1. An in line bar system impregnator for inline gassing of a nonaerated or only slightly aerated beverage precursor product with a gas in a bar system, comprising:

a mixing cell having a liquid inlet, a gas inlet, and an outlet; and a high-frequency or ultrasonic vibrator acting on an interior of the mixing cell, wherein:

both the liquid inlet and the gas inlet discharge into the mixing cell, at least one impregnator body is disposed in the mixing cell in such a way that a flow of the beverage precursor product through the mixing cell must necessarily take place through the impregnator body, and the impregnator body includes a solid body having pores, said solid body being made of a foam material, a sponge, or a sintered material.

2. An inline bar system impregnator as claimed in claim 1, wherein the gas is carbon dioxide or nitrogen.

3. An inline bar system impregnator as claimed in claim 2, wherein the beverage precursor product is a slightly effervescent beer precursor product or a beer precursor product containing no carbon dioxide.

4. An inline bar system impregnator as claimed in claim 1, wherein the beverage precursor product is a precursor of one of a soda, soft drink, water, and juice.

5. An inline bar system impregnator as claimed in claim 1, wherein the inline bar system impregnator body is a disk that fills a diameter of the mixing tube.

6. An impregnator as claimed in claim 1, wherein the impregnator body, provided with a mounting, is an impregnation cartridge that fills a diameter of the mixing tube.

7. An inline bar system impregnator as claimed in claim 1, wherein, disposed downstream of the at least one impregnator body, is a calming zone that is separated from the inlet side of the mixing tube by the impregnator body.

8. An inline bar system impregnator as claimed in claim 7, wherein the calming zone is a mixing tube portion.

9. An inline bar system impregnator as claimed in claim 1, wherein, disposed downstream of the at least one impregnator body, is a calming chamber adjoining the mixing cell.

10. An inline bar system impregnator as claimed in claim 1, further comprising a head piece that seals off the mixing cell from surroundings on a gas and liquid inlet side of the mixing cell, said head piece being provided with one connection for a liquid infeed line and one connection for a gas infeed line.

11. An inline bar system impregnator as claimed in claim 10, wherein the head piece is penetrated by a liquid channel, which discharges into the mixing tube eccentrically or annularly with respect to a mixing tube axis, and by a gas passage channel, which discharges into the mixing tube centrally to the mixing tube axis.

12. An inline bar system impregnator as claimed in claim 11, wherein the liquid channel is secured by a check valve.

13. An inline bar system impregnator as claimed in claim 12, wherein the gas passage channel is secured by a check valve.

14. An inline bar system impregnator for inline gassing of a nonaerated or only slightly aerated beverage precursor product with a gas in a bar system, comprising:

a mixing cell having a liquid inlet, a gas inlet, and an outlet, wherein:

both the liquid inlet and the gas inlet discharge into the mixing cell, at least one impregnator body is disposed in the mixing cell in such a way that a flow of the beverage precursor product through the mixing cell must necessarily take place through the impregnator body, the impregnator body includes a solid body having pores, said solid body being made of a foam material, a sponge, or a sintered material, the mixing cell is a tubular mixing cell and the outlet is a pressure compensator assembly having a line segment that forms a portion of a beverage infeed line and a throttle restriction disposed movably in the line segment, which throttle restriction, during the tapping operation, opens a cross section of the line segment for a beverage to be tapped, so that a beverage flows past it at its surface, the throttle restriction is prestressed, counter to the beverage flow, toward one wall of the line segment via a prestressing device such that below a predetermined pressure difference between an inlet side and an outlet side, the cross section is not opened, and the prestressing device includes at least one spring, by way of which the throttle restriction is braced counter to the beverage flow.

15. An inline bar system impregnator as claimed in claim 14, wherein the line segment widens, at least in an inlet-side portion, in the direction toward a dispensing tap, and the throttle restriction has the shape of an elongated body, which becomes thicker in the manner of a truncated cone with the widening of the line segment, and wherein an inlet-side tip of the throttle restriction is rounded.

16. An inline bar system impregnator as claimed in claim 15, wherein the mixing cell has a tubular body forming a threaded stopper that can be screwed onto a female-threaded flange.

17. An impregnating system for mixing a beverage precursor product with a plurality of gases, including a plurality of impregnators for inline gassing of a nonaerated or only slightly aerated beverage precursor product with a gas in a bar system, comprising:

a mixing cell having a liquid inlet, a gas inlet, and an outlet, wherein:

both the liquid inlet and the gas inlet discharge into the mixing cell, at least one impregnator body is disposed in the mixing cell in such a way that a flow of the beverage precursor product through the mixing cell must necessarily take place through the impregnator body, the impregnator body includes a solid body having pores, said solid body being made of a foam material, a sponge, or a sintered material, and said plurality of impregnators are connected in series in such a way that the outlet of a preceding inline bar system impregnator communicates with the liquid inlet of a following inline bar system impregnator.

18. A bar system with inline gassing, having a beverage infeed line to a dispensing tap, and comprising an inline bar system impregnator as defined by one of claims 1 through 6 or an impregnation system as defined by claim 17 is provided.

19. An inline bar system impregnator for inline gassing of a nonaerated or only slightly aerated beverage precursor product with a gas in a bar system, comprising:

a mixing cell having a liquid inlet, a gas inlet, and an outlet, wherein:

both the liquid inlet and the gas inlet discharge into the mixing cell;

at least one impregnator body is disposed in the mixing cell in such a way that a flow of the beverage precursor product through the mixing cell must necessarily take place through the impregnator body, the impregnator body includes a solid body having pores, said solid body being made of a foam material, a sponge, or a sintered material, and the impregnator comprises a line segment in which a throttle restriction is disposed, said line segment having a rectilinear course in terms of flow and adjoining an inline bar system impregnator that has a vertical, downward-oriented flow direction in the mixing cell.

20. An inline bar system impregnator for inline gassing of a nonaerated or only slightly aerated beverage precursor product with a gas in a bar system, comprising:

a mixing cell having a liquid inlet, a gas inlet, and an outlet, wherein:

both the liquid inlet and the gas inlet discharge into the mixing cell, at least one impregnator body is disposed in the mixing cell in such a way that a flow of the beverage precursor product through the mixing cell must necessarily take place through the impregnator body, the impregnator body includes a solid body having pores, said solid body being made of a foam material, a sponge, or a sintered material, and said impregnator body is a first impregnator body comprising a first porous material and followed downstream in the mixing cell by at least one second impregnator body comprising one or more other porous materials.

21. An inline bar system impregnator for inline gassing of a nonaerated or only slightly aerated beverage precursor product with a gas in a bar system, comprising:

a mixing cell having a liquid inlet, a gas inlet, and an outlet, wherein:

both the liquid inlet and the gas inlet discharge into the mixing cell;

at least one impregnator body is disposed in the mixing cell in such a way that a flow of the beverage precursor product through the mixing cell must necessarily take place through the impregnator body, the impregnator body includes a solid body having pores, said solid body being made of a foam material, a sponge, or a sintered material, and the impregnator is arranged to be broken down into its individual parts, a head piece preferably being screwed into the mixing tube and a gas outlet being provided in a truncated tube screwed into an interior of the mixing tube onto the head piece.

22. An inline bar system impregnator for inline gassing of a nonaerated or only slightly aerated beverage precursor product with a gas in a bar system, comprising:

a mixing cell having a liquid inlet, a gas inlet, and an outlet; and a second gas inlet or a second gas infeed line connection for feeding a second gas into the mixing cell, wherein:

both the liquid inlet and the gas inlet discharge into the mixing cell, at least one impregnator body is disposed in the mixing cell in such a way that a flow of the beverage precursor product through the mixing cell must necessarily take place through the impregnator body, and the impregnator body includes a solid body having pores, said solid body being made of a foam material, a sponge, or a sintered material.

23. An inline bar system impregnator for inline gassing of a nonaerated or only slightly aerated beverage precursor product with a gas in a bar system, comprising:

a mixing cell having a liquid inlet, a gas inlet, and an outlet, wherein:

both the liquid inlet and the gas inlet discharge into the mixing cell, at least one impregnator body is disposed in the mixing cell in such a way that a flow of the beverage precursor product through the mixing cell must necessarily take place through the impregnator body, the impregnator body includes a solid body having pores, said solid body being made of a foam material, a sponge, or a sintered material, the mixing cell has a mixing tube axis, a gas inlet valve, and a liquid inlet valve, said gas and liquid inlet valves being arranged for opening and closing the gas and liquid inlets in accordance with a magnitude of a pressure drop from the inlet side to the mixing cell, the gas inlet valve has a gas inlet closing element disposed in a gas inlet channel, and the liquid inlet valve has a liquid inlet closing element disposed in the liquid inlet channel, and the gas inlet closing element and the liquid inlet closing element are coupled to one another in such a way that the gas inlet valve opens the gas inlet to a predetermined degree of opening, as a function of a degree of opening of the liquid inlet.

24. An inline bar system impregnator as claimed in claim 23, wherein the liquid inlet channel has a liquid inlet blocking portion aligned with a gas inlet blocking portion of the gas inlet channel, the liquid inlet closing element and the gas inlet closing element are joined with an elongated valve slide unit, wherein the liquid inlet closing element fills the liquid inlet blocking portion and the gas inlet closing element fills the gas inlet blocking portion in a closing position, and wherein, in an opening position, the liquid and gas inlet closing elements open a flow to a degree that corresponds to the pressure drop toward the mixing cell.

25. An inline bar system impregnator as claimed in claim 23, wherein the liquid inlet closing element is a hollow body surrounded on multiple sides, which is open toward the liquid infeed side, and the gas inlet closing element is a hollow body, surrounded on multiple sides, which toward the mixing cell side has at least one mixing cell opening, and wherein in each of the walls surrounding the respective hollow bodies on multiple sides at least one respective liquid passage for the beverage precursor product and at least one gas passage for the gas are provided, and wherein the liquid inlet closing element, in an opening position, protrudes into a volume on the side toward the mixing cell in such a way that the liquid passage is at least partly opened, and the gas inlet closing element protrudes into a volume on the side toward the gas inlet in such way that the gas passage is at least partly opened.

26. An inline bar system impregnator as claimed in claim 25, wherein, at least for the gas inlet closing element, a seal is provided on the gas inlet blocking portion.

27. An inline bar system impregnator as claimed in claim 25, wherein the liquid inlet blocking portion has a larger diameter than the gas inlet blocking portion, and the liquid inlet closing element adjoins the gas inlet closing element via a shoulder on which an annular spring, functioning as a prestressing device, is braced on one end, which spring surrounds the gas inlet closing element in a piston slide portion, and is braced on its other end on a wall that defines the volume on the side toward the mixing cell.

28. An inline bar system impregnator as claimed in claim 27, wherein liquid passages include bores which are distributed over the wall of the liquid inlet closing element.

29. An inline bar system impregnator as claimed in claim 27, wherein gas passages include bores which are distributed over the wall of the gas inlet closing element.

30. An inline bar system impregnator as claimed in claim 23, wherein the liquid inlet closing element and/or the gas inlet closing element is a cylindrical body or has a cylindrical shape.

31. An inline bar system impregnator as claimed in claim 23, wherein liquid passages and/or gas passages are disposed as a chain of bores disposed in a spiral about a side wall of the respective liquid or gas closing element.

32. An inline bar system impregnator as claimed in claim 23, wherein the liquid inlet closing element is prestressed toward the liquid inlet side by a prestressing device, and the gas inlet closing element and the liquid inlet closing element are joined together in one piece, so that a displacement of the liquid inlet closing element is transmitted to the gas inlet closing element.

33. An inline bar system impregnator as claimed in claim 20, 22, 23, or 32, wherein the gas is carbon dioxide or nitrogen.

34. An inline bar system impregnator as claimed in claim 20, 22, 23, or 32, wherein the beverage precursor product is a slightly effervescent beer precursor product or a beer precursor product containing no carbon dioxide.

35. An inline bar system impregnator as claimed in claim 20, 22, 23, or 32, wherein the beverage precursor product is a precursor of one of a soda, soft drink, water, and juice.

* * * * *